United States Patent [19]

Vreeswijk et al.

[11] 4,133,630

[45] Jan. 9, 1979

[54] COMBUSTION FLASHLIGHT LAMP

[75] Inventors: Johannes C. A. Vreeswijk, Terneuzen; Rudolf M. Kruimink, Eindhoven, both of Netherlands

[73] Assignee: U.S. Philips Corporation, New York, N.Y.

[21] Appl. No.: 769,009

[22] Filed: Feb. 16, 1977

[30] Foreign Application Priority Data

Mar. 4, 1976 [NL] Netherlands ..... 7602231

[51] Int. Cl.[2] ..... F27D 1/08

[52] U.S. Cl. ..... 431/359; 362/6; 362/11

[58] Field of Search ..... 431/95, 95 A; 149/42, 149/44; 240/1.3

[56] References Cited

U.S. PATENT DOCUMENTS 3,041,862 7/1962 Anderson et al. ..... 431/95

4,036,578 7/1977 Herman ..... 431/95

FOREIGN PATENT DOCUMENTS 2304607 1/1973 Fed. Rep. of Germany ..... 431/95

*Primary Examiner*—Edward G. Favors

*Attorney, Agent, or Firm*—Thomas A. Briody; David R. Treacy; Robert S. Smith

[57] ABSTRACT

Combustion flashlight lamps for high-voltage ignition, in which two current conductors in the lamp envelope debouch on the surface of an insulating member, have an ignition mass which is provided on the surface of the insulating member and connects the current conductors, which mass contains 60–90% by volume of metal powder and 40–10% by volume of $KClO_4$.

The metal powder consists of zirconium or a zirconium containing mixture. $KClO_4$ may be replaced fully or partly by another oxidation agent.

The lamps have readily defined chemical properties, which after ignition are different from those prior to ignition, and are suitable for being incorporated in a series arrangement in flash devices in which a flashed lamp serves as a make switch.

5 Claims, 3 Drawing Figures

COMBUSTION FLASHLIGHT LAMP

The invention relates to a combustion flashlight lamp for high-voltage ignition having a lamp envelope in which an actinically combustible metal wool and an oxidizing gas are present, through the wall of which lamp envelope current conductors are passed in a vacuum-tight manner from the exterior into the lamp envelope, said current conductors being connected in the lamp envelope by an ignition mass consisting of a mixture comprising metal powder, oxidising agent and binder provided on an insulating surface.

Such a lamp is disclosed in U.S. Pat. No. 3,627,459. The ignition mass of the known lamp comprises, in addition to the said components, red phosphorus and lanthanum cobaltite, while the volumes of the metal powder (zirconium) and the oxidising agent $KClO_4$ are in the ratio of 1:2.

The known lamp may be used in a flashing device in which the lamps are electrically connected in parallel. When the device is connected to a high-voltage source, for example a piezo-electric crystal, always that lamp will be ignited which has the lowest breakdown voltage. This imposes the requirement that a lamp, after ignition, must have a high resistance since otherwise no other lamp could subsequently be ignited. The said Patent Specification states that when the lamps described therein are used in devices having a parallel arrangement, no failures occur which are due to internal short-circuits.

In the non-prepublished Netherlands Pat. application No. 7,506,653 flash devices are described having several series-connected high-voltage-ignited flashlight lamps in which it is desired to shunt each flashlight lamp with a capacitor in the case in which it is not ensured that the electrical properties, in particular the capacitive value, of a flashed lamp are within certain limits.

It is an object of the invention to provide flashlight lamps for high-voltage ignition which are suitable for use in a series arrangement without it being necessary for the reliability of operation to use capacitors or other electrical components in the circuit. Another object of the invention is to provide lamps which both prior to and after flashing have readily defined electrical properties and in which it is possible, without visual inspection of a lamp, to distinguish between a lamp already flashed and a lamp not yet ignited.

In agreement herewith the invention relates to a combustion flashlight lamp for high-voltage ignition of the kind mentioned in the preamble which is characterized in that the ignition mass consists of 60–90% by volume of a metal powder consisting of 3 parts by volume of zirconium and 0–1 part by volume of another metal and 40–10% by volume of $KClO_4$ or a chemically equivalent quantity of another oxidation agent dispersed in a binder.

As is often the case in high-voltage-ignited lamps, the internal resistance of the lamp according to the invention prior to ignition is very high: $10^8$ to $10^{10}$ ohms measured at 20 V and an electrode separation of 0.7 mm. The resistance in a flashed lamp on the contrary, and in contrast with the known lamp, is low: $<10^4$ ohms.

Therefore, the measurement of the internal resistance of a lamp according to the invention is a simple means to distinguish between flashed lamps and non-ignited lamps. Furthermore, the low resistance of a flashed lamp makes it possible in a flashing device having several lamps to ignite a subsequent lamp with a voltage pulse which is conducted via a lamp already flashed. Hence the lamps may also be considered as make switches which are closed without mechanical or physical means when the lamps are ignited.

It is to be noted that combustion flashlight lamps are known from German Offenlegungsschrift No. 2,304,607 which structurally correspond to the lamps according to the invention. However, as regards their electrical properties said lamps differ from the lamp according to the invention.

In the manufacture of the said known lamps, before oxygen is admitted in the lamp envelope, a breakdown in a vacuum by the ignition mass is produced by means of a piezo-electric crystal after which the lamp is filled with oxygen and sealed.

As a result of this treatment, the lamp has a resistance of less than $10^5$ ohms (at 20 V) prior to ignition and can consequently ignite at an applied voltage of less than 100 volts.

The ignition mass which is used in the known lamps comprises 160 parts by weight of zirconium powder and 60 parts by weight of potassium perchlorate powder. Calculated in percent by volume (Zr s.g. 6.5; $KClO_4$ s.g. 2.5) the mass of the known lamp comprised 50% by volume of zirconium powder and 50% by volume of $KClO_4$.

The ignition mass which is used in the said known lamps has proved to be unsuitable for use in the lamp according to the invention since lamps with the known ignition mass in the majority of cases have a resistance of more than $10^8$ ohms after flashing. Not only do said lamps not satisfy the requirement that after flashing they should have a low resistance and therefore serve as make switches, but also the lamps have no other resistance after flashing than before flashing if during the manufacture of the lamp the extra and expensive operation of breakdown in a vacuum is not used.

As examples of metals which may be added to the zirconium in the ignition mass may be mentioned: iron, cobalt, copper, nickel, zinc. tungsten, molybdenum, aluminium, magnesium, tin and mixtures of two or more thereof, for example, aluminium/magnesium (1:1 weight/weight) alloy.

An attractive aspect of the ignition mass which is used in the lamp according to the invention is the simplicity of its composition. It has been found that lamps which have an ignition mass with one or more of the metals iron, nickel, tin and tungsten have a lower breakdown voltage than otherwise identical lamps in which instead of the said metals another metal is present, for example zirconium. However, ignition masses having a sufficiently low breakdown voltage are also obtained without the use of said metals. The use of iron has proved to be particularly attractive. This metal is available as a powder having readily defined properties, for example, the so-called carbonyl iron powder which has been prepared from iron carbonyl.

In addition to $KClO_4$ which in the above description of the lamp according to the invention serves as a reference with respect to the mixing ratio of the components of the ignition mass, inter alia other known oxidizing agents as well as mixtures therewith may be used in ignition masses. As examples of oxidizing agents are mentioned: perchlorates, chlorates, bichromates, chromates, nitrates, permanganates, peroxides and mixtures therewith, for example, potassium nitrate, potassium chromate and potassium bichromate, sodium chlorate, ammonium perchlorate, manganese dioxide, lead dioxide, chromium dioxide. By using mixtures, for example mixtures of potassium bichromate and potassium perchlorate, as oxidizing agents, favourable aspects of the individual oxidizing agents can be combined, for example, the comparatively great reactivity of potassium bichromate with the comparatively low breakdown voltage which potassium perchlorate confers on a mass.

When potassium perchlorate is replaced fully or partly by one or more other oxidising agents, the quantity thereof can be calculated by comparing the oxidising capacity of said oxidising agents (the quantity of metal powder which can be burnt) with that of potassium perchlorate.

Metal and oxidising agent are preferably present in a finely divided form. They preferably have an average grain size of at most 10 μm, in particular approximately 5 μm.

The ignition mass comprises preferably 75–85% by volume of metal powder and 15–25% by volume of $KClO_4$ or an equivalent quantity of another oxidising agent.

In manufacturing the ignition mass, metal powder and oxidation agent are dispersed in a solution of the binder, for example nitrocellulose, in an organic solvent, for example ethyl glycol, ethyl acetate, acetone, ethyl acetate or hydroxy ethyl cellulose in water. The dispersion is then introduced into the lamp after which the solvent is removed from the lamp.

As a rule 1–5% by weight of binder calculated on the overall weight of metal powder and oxidising agent is used.

If desired, the ignition mass may be coated with a layer of binder. Dependent upon the geometry of the lamp this may be desirable to prevent during the ignition of the lamp the flowing away of the charge towards the metal wool or to achieve that an electrostatic charge formed by friction flows away from the metal wool to the current conductors and ignites the lamp.

The invention will be described in greater detail with reference to the figures and the examples.

Figure 1:
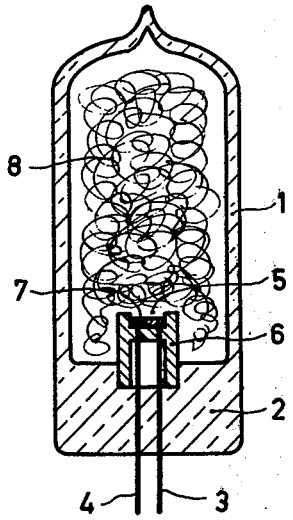
FIG. 1 is a longitudinal sectional view through a flashlight lamp.

The lamp envelope 1 in FIG. 1 is sealed at its lower side by a pinch 2 through which extend current conductors 3 and 4 debouching into a cavity 5 of an insulating member 6 which is secured to the pinch 2. Ignition mass 7 which connects the current conductors 3 and 4 is provided in the cavity 5. The lamp envelope is filled with a metal wool 8 and oxidising gas.

Figure 2:
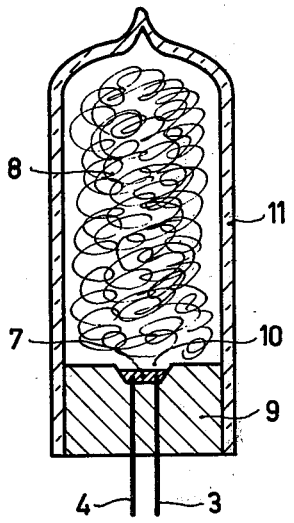
FIG. 2 is a longitudinal sectional view through another flashlight lamp.

In FIG. 2 components which correspond to components of FIG. 1 are referred to by the same reference numerals. Reference numeral 9 in this figure is a preshaped bottom portion having a cavity 10 and being sealed to the wall portion 11.

Figure 3:
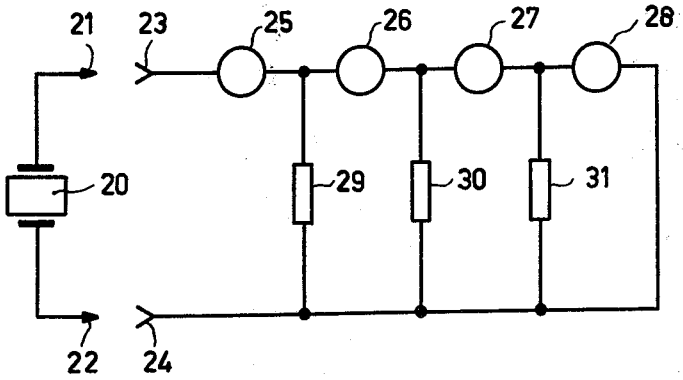
FIG. 3 is a circuit diagram of a flashing device in which lamps according to the invention are used.

Reference numeral 20 in FIG. 3 denotes a high-voltage source having output terminals 21 and 22 which can be connected to the input terminals 23 and 24 of a flashing device in which the combustion flashlight lamps 25, 26, 27 and 28 are arranged in series. 29, 30 and 31 denote break switches.

When the input terminals 23 and 24 are each connected to an output terminal (21, 22) and the high voltage source 20 is actuated for the first time, a high voltage pulse is generated which traverses the circuits 23, 25, 29, 24. The lamp 25 is ignited and the break switch 29 is irradiated as a result of which it fuses. The resistance of lamp 25 which initially was approximately $10^{10}$ ohms has decreased to a value below $10^4$ ohms as a result of the ignition. When the voltage source 20 is actuated for the second time, the high-voltage pulse traverses the circuit 23, 25, 26, 30, 24. The lamp 26 ignites and the switch 30 fuses as a result of which the short-circuit of lamp 27 is removed and said lamp is ready for ignition.

EXAMPLE

In a specific example a high-voltage-ignited combustion flashlight lamp had a hard glass lamp envelope having an inside diameter of 4.6 mm and a capacity of 0,4 $cm^3$. The lamp was provided with 14 mg of zirconium wool (wire dimensions 0.02 × 0.02 × 7 mm) and oxygen to a pressure of 15 atmospheres. Two fernico (18% by weight of Co, 28% by weight of Ni, 54% by weight of Fe) current conductors in the lamp envelope had a mutual distance of 0.8 mm and were connected together by means of 2 mg of an ignition mass which was provided on an insulating surface. The lamps were ignited by a high-voltage pulse generated by a piezoelectric crystal. The results of a few lamps having ignition masses of different compositions are stated in the following table.

| Ignition mass composition in Vol.% | | $V_{d\,l\,(kV)}$ | $R_1$ (ω) | $R_2$ (ω) |
|---|---|---|---|---|
| 85% Zr, | 15% $KClO_4$ | 0,7 | $>10^{10}$ | $<10^4$ |
| 68% Zr, | 22% Fe, 10% $KClO_4$ | 0,3 | $>10^{10}$ | $<10^4$ |
| 63% Zr, | 17% Ni, 20% $KClO_4$ | 0,3 | $>10^{10}$ | $<10^4$ |
| 85% Zr, | 15% $PbO_2$ | 0,5 | $>10^8$ | $<10^4$ |
| 63% Zr, | 17% Fe, 10% $KClO_4$ 10% $K_2Cr_2O_7$ | 0,5 | $>10^{10}$ | $<10^4$ |
| 60% Zr, | 40% $KClO_4$ | 0,9 | $>10^{10}$ | $<10^4$ |
| 74,5% Zr, | 25,5% $KClO_4$* | 0,8 | $>10^8$ | $<10^4$ |

Ignition mass with 3% by weight of nitrocellulose, and 1% by weight of hydroxyethyl cellulose (*) respectively. A 6% by weight solution of the nitrocellulose used in ethylglycol has a viscosity of 20 cP; a 2% by weight solution of the hydroxyethyl cellulose used in water a viscosity of 300 cP.

$V_d$ = breakdown voltage; $R_1$ = resistance prior to ignition;

$R_2$ = resistance after ignition. The zirconium powder had a grain size of 2–4 μm and was bought from Messrs. Ventron.

What is claimed is:

1. A combustion flash lamp for high-voltage ignition which comprises a lamp envelope, an actinically combustible metal wool disposed in said envelope, an oxidizing gas disposed in said envelope, at least two current conductors extending through the wall of said envelope in a vacuum-tight manner, an insulating surface disposed in said envelope, an ignition mass in said lamp envelope on said insulating surface, said ignition mass being physically connected at all times to each of said two current carrying conductors and electrically conductive only after flashing of said lamp, said ignition mass consisting of a mixture of a binder and other ingredients comprising a metal powder, and an oxidation agent, said other ingredients being 60–90% by volume of a metal powder consisting of 3 parts by volume of zirconium and 0–1 part by volume of another metal and 40–10% by volume of $KClO_4$ or a chemically equivalent quantity of another oxidation agent, said other ingredients being dispersed in said binder.

2. A combustion flash lamp as claimed in claim 1 wherein the metal powder in the ignition mass consists of 3 parts by volume of zirconium, and 0–1 part by volume of at least one of the metals selected from the group consisting of iron, cobalt, copper, nickel, zinc, tungsten, molybdenum, aluminium, magnesium and tin.

3. A combustion flash lamp as claimed in claim 2 wherein said metal powder contains up to 1 part by volume of iron, nickel, tin, tungsten or mixtures thereof per 3 parts by volume of zirconium.

4. A combustion flash lamp as claimed in claim 3 wherein said metal powder contains up to 1 part by volume of iron per 3 parts by volume of zirconium.

5. A combustion flash lamp assembly which comprises a plurality of a flash lamps as described in claim 1, each of said plurality of lamps being connected in series relationship by a plurality of first conductors, each first connector connecting two of said lamps which are connected in series relationship, a second conductor connected to the first of said plurality lamps connected in said series relationship, a third conductor connected to the last of said lamps connected in series, and a plurality of break switches which open responsive to flashing of one of said plurality of flash lamps, each break switch being connected between each of said first conductors and said third conductor.

* * * * *